US006527356B1

(12) United States Patent
Spurr et al.

(10) Patent No.: US 6,527,356 B1
(45) Date of Patent: Mar. 4, 2003

(54) PRINTER CAPABLE OF FORMING AN IMAGE ON A RECEIVER SUBSTRATE ACCORDING TO TYPE OF RECEIVER SUBSTRATE AND A METHOD OF ASSEMBLING THE PRINTER

(75) Inventors: Robert W. Spurr, Rochester, NY (US); Kurt M. Sanger, Rochester, NY (US); Timothy J. Tredwell, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/586,611

(22) Filed: Jun. 2, 2000

(51) Int. Cl.[7] ..... B41J 29/38; B41J 2/01

(52) U.S. Cl. ..... 347/16; 347/104

(58) Field of Search ..... 347/16, 105, 14, 347/19, 212; 400/120.18

(56) References Cited

U.S. PATENT DOCUMENTS

| | | | | |
|---|---|---|---|---|
| 4,129,855 A | | 12/1978 | Rodrian | |
| 4,247,758 A | | 1/1981 | Rodrian | |
| 4,527,171 A | * | 7/1985 | Takanashi et al. | 347/212 |
| 4,663,625 A | | 5/1987 | Yewen | |
| 4,742,470 A | | 5/1988 | Juengel | |
| 4,806,958 A | | 2/1989 | Momot et al. | |
| 4,880,325 A | | 11/1989 | Ueda et al. | |
| 5,008,661 A | | 4/1991 | Raj | |
| 5,019,815 A | | 5/1991 | Lemelson et al. | |
| 5,049,898 A | | 9/1991 | Arthur et al. | |

(List continued on next page.)

FOREIGN PATENT DOCUMENTS

| | | | | |
|---|---|---|---|---|
| AU | 1607197 | | 8/1997 | |
| NL | 9400392 | | 10/1995 | |
| WO | WO-98/52762 A2 | * | 11/1998 | ..... B41J/2/01 |

OTHER PUBLICATIONS

TEMIC Semiconductors TK5550, Read/Write Transponder, Transponder, TELEFUNKEN Semiconductors, Rev. A1, Apr. 30, 1997.

(List continued on next page.)

*Primary Examiner*—John Barlow
*Assistant Examiner*—Michael S Brooke
(74) *Attorney, Agent, or Firm*—Walter S. Stevens; Norman Rushefsky

(57) ABSTRACT

A printer capable of forming an image on a receiver substrate according to type of receiver substrate, and a method of assembling the printer. An identifier containing identifier information is associated with each component of the receiver substrate which, for example, comprises paper and, optionally, laminate media. A sensor is disposed to read the identifier information so that an image forming operation can be adjusted based on identified receiver substrate components and media. For example transponder, serving as the identifier, is coupled to a memory device capable of storing information characteristic of media type. A transceiver, serving as the sensor, is disposed within the printer. The transceiver includes antennae disposed for polling an individual transponder attached to each media type. The transponder receives a first radio frequency field from the transceiver and, deriving power and address information from the first frequency, then generates a second radio frequency field in response. The second radio frequency field is characteristic of the data stored in the memory. As instructed by a control logic processor, the transceiver can both read manufacturing data from the transponder concerning the media type or write usage and processing data to the transponder for storage in the memory.

48 Claims, 8 Drawing Sheets

U.S. PATENT DOCUMENTS 5,049,904 A 9/1991 Nakamura et al.
5,078,523 A 1/1992 McGourty et al.
5,104,247 A 4/1992 Ohshima
5,105,190 A 4/1992 Kip et al.
5,184,152 A 2/1993 French
5,184,181 A * 2/1993 Kurando et al. ..... 399/262
5,185,315 A 2/1993 Sparer
5,196,846 A 3/1993 Brockelsby et al.
5,196,862 A 3/1993 Fisher, Sr.
5,224,784 A 7/1993 Haftmann et al.
5,266,968 A 11/1993 Stephenson
5,268,708 A 12/1993 Harshbarger et al.
5,297,881 A 3/1994 Ishiyama
5,305,020 A 4/1994 Gibbons et al.
5,318,370 A 6/1994 Nehowig
5,331,338 A 7/1994 Mager
5,342,671 A * 8/1994 Stephenson ..... 428/195
5,361,085 A * 11/1994 Vance ..... 437/101
5,385,416 A 1/1995 Maekawa et al.
5,426,011 A 6/1995 Stephenson
5,430,441 A 7/1995 Bickley et al.
5,455,617 A 10/1995 Stephenson et al.
5,488,223 A * 1/1996 Austin et al. ..... 347/19
5,491,327 A 2/1996 Saroya
5,491,468 A 2/1996 Everett et al.
5,493,385 A 2/1996 Ng
5,504,507 A 4/1996 Watrobski et al.
5,513,920 A 5/1996 Whritenor et al.
5,562,352 A * 10/1996 Whritenor et al. ..... 400/242
5,565,906 A 10/1996 Schoon
5,598,201 A 1/1997 Stodder et al.
5,600,350 A 2/1997 Cobbs et al.
5,600,352 A 2/1997 Knierim et al.
5,610,635 A 3/1997 Murray et al.
5,620,265 A 4/1997 Kondo
5,635,969 A * 6/1997 Allen ..... 347/19
5,647,679 A 7/1997 Green et al.
5,661,515 A 8/1997 Hevenor et al.
5,713,288 A 2/1998 Frazzitta
5,728,576 A * 3/1998 Kaszczuk et al. ..... 346/135.1
5,742,306 A * 4/1998 Gompertz et al. ..... 347/14
5,755,519 A 5/1998 Klinefelter
5,757,394 A 5/1998 Gibson et al.
5,774,639 A 6/1998 Schildkraut et al.

OTHER PUBLICATIONS

TEMIC Semiconductors e5550, Stndard Read/Write Identification IC, TELEFUNKEN Semiconductors, Rev. A3, Mar. 17, 1998.

Pending U.S. application Ser. No. 09/133/114, Printer With Media Supply Spool Adapted To Sense Type Of Media, And Method Of Assembling Same, filed Aug. 12, 1998.

Pending U.S.application Ser. No. 09/281,595, A Printer With Donor And Receiver Media Supply Trays Each Adapted To Allow A Printer To Sense Type Of Media Therein, And Method Of Assembling The Printer And Trays, filed Dec. 22, 1998.

* cited by examiner

PRINTER CAPABLE OF FORMING AN IMAGE ON A RECEIVER SUBSTRATE ACCORDING TO TYPE OF RECEIVER SUBSTRATE AND A METHOD OF ASSEMBLING THE PRINTER

BACKGROUND OF THE INVENTION

This invention generally relates to printers and printer methods and more particularly relates to a printer capable of forming an image on a receiver substrate according to type of receiver substrate, and a method of assembling the printer.

Digital prepress color proofing is an example of a printing application in which there are significant demands for accuracy in representation of images. In digital prepress color proofing, the goal is to produce a "proof sheet" that will resemble as closely as possible the final output of a color printing system (e.g., an offset color printer). This requires that the proof sheet match both expected color reproduction as well as "look and feel" of the receiver substrate. The more accurately a prepress proofing system reproduces paper thickness, weight, color, gloss, and other characteristics in the color proof, the better the system will provide final output prints that meet customer expectations.

Color proofing devices are known. A laser thermal printer having color proofing capability is disclosed in commonly assigned U.S. Pat. No. 5,268,708 titled "Laser Thermal Printer With An Automatic Material Supply" issued Dec. 7, 1993 in the name of R. Jack Harshbarger, et al. The Harshbarger, et al. device is capable of producing a proof on a number of different paper stocks that differ by weight, gloss, color, and other characteristics. For a high-quality imaging system such as is disclosed in the Harshbarger, et al. patent, it is possible to vary specific parameters in the printing process in order to achieve a desired result.

According to the Harshbarger, et al. patent, a printer accepts a rasterized image from a prepress workstation and a printer device prints this raster image, with the necessary color density, onto an intermediate receiver. This intermediate receiver holds the image in reversed or "mirrored" form. The intermediate receiver is ultimately used to transfer an image onto a preconditioned, prelaminated paper substrate. In this regard, a prelamination procedure, performed using a laminator apparatus, is used to precondition the paper substrate for printing by applying a thin layer of laminate material onto the surface of the paper substrate. This prelamination procedure conditions the surface of the paper substrate for accepting the image transferred from the intermediate receiver, allowing a predictable and accurate response to colorant levels. When a sheet of paper substrate is thus prepared, an image is then transferred from the intermediate receiver using the laminator apparatus to provide appropriate levels of heat and pressure as it presses the intermediate receiver against the preconditioned paper substrate. The image is thus transferred to the sheet of paper substrate. It should be noted that this image transfer operation is carried out completely inside the laser thermal printer disclosed in the Harshbarger, et al. patent.

It is known that one of the key parameters that can be varied by a laser thermal printer, whether transferring colorant directly to the paper substrate or first to an intermediate receiver, is colorant density. Density can be controlled within a specified range of values by varying the exposure energy levels applied, which in turn determines the amount of colorant transferred by a marking apparatus during the printing process. By varying exposure energy applied to create the image on an intermediate receiver, a laser thermal printer can emulate the actual printing performance of an offset color press or other printers when using paper substrates having certain characteristics. Similarly, an inkjet printer or electrophotographic printer can be adjusted so as to emulate color press output, by varying the amount of colorant applied or by adjusting operational variables such as drying time or fusing temperature and speed. In any event, chief among the characteristics of the paper substrate is the color of the paper substrate, which serves as a background for the printed image. However, paper substrates can vary widely in color content, ranging from a bright white color that is typical of photographic papers, to duller colors such as are typical of newsprint papers. In order to adjust printer exposure to correctly compensate for paper color, an operator using a digital prepress proofing system makes densitometer measurements of paper color content prior to printing. Such measurements provide values that can be used to calculate an appropriate amount of compensation in printer exposure (or in other operational variables) for a given type of paper substrate. However, the need for the operator to make densitometer measurements of paper color content prior to printing is time-consuming, prone to operator error and therefore costly. Hence, a problem in the art is increased costs due to the need for the operator to make densitometer measurements of paper color content prior to printing.

The densitometer measurements mentioned hereinabove are used to calibrate the printer. In other words, for the system disclosed in the Harshbarger, et al. patent, initial compensation for paper characteristics is based on measurements taken as a part of overall system calibration. In the process for calibrating the printer located at a specific site, the RGB density of a paper type typically used at that site is measured using a densitometer. Then, in modeling colorant density versus exposure for a printer, the density of the underlying paper substrate is subtracted from colorant density measurements. It should be noted that this procedure provides a workable estimate for making calibration adjustments. However, if a site uses two or more papers that vary widely in color characteristics, some compromise in calibration strategy must then be used. Therefore, another problem in the art is the need to compromise calibration strategy if a site uses two or more papers that vary widely in color characteristics.

Additional compensation for paper substrate characteristics is provided by dot-gain profiles used with prior art prepress proofing systems, such as the system disclosed in the Harshbarger, et al. patent. A dot-gain profile models the real-world behavior of offset color printing inks when applied to paper at various values of halftone screen, where there is typically some amount of "gain" in the nominal dot size based on ink spreading and other factors. The Harshbarger, et al. device allows an operator to setup and use a number of different dot-gain profiles, based on factors such as the specific press being emulated, the specific paper being used, and the specific screen size being employed. Based on the dot-gain profile selected, and a predetermined target density, the printer adjusts dot characteristics and exposure when creating the image on the intermediate receiver in order to emulate the real-world behavior of ink on paper substrate. In order to use dot-gain profiles effectively, an operator must know, in advance, details about the paper that will be used for the proof and, ultimately, for the print job. Therefore, another problem in the art is pre-knowledge the operator must acquire concerning details about paper properties that will be used in making the proof.

Still other compensation for paper substrate characteristics can be applied during other phases of the imaging process. For example, with the system disclosed in the Harshbarger, et al. patent, the prelaminate material itself can have characteristics that affect the color of the paper substrate. Additionally, the colorant transfer process, in which the image is transferred from an intermediate receiver onto the paper substrate, requires adjustment to compensate for paper characteristics. An apparatus designed for colorant transfer must typically vary heat, pressure, and contact time to control the effectiveness of colorant transfer, affecting the density of the final printed image. Hence, another problem in the art is need for the operator to ascertain how the prelaminate material will affect color of the paper and the need for the operator to ascertain how to vary heat, pressure, and contact time to control the effectiveness of colorant transfer which affects density of the final printed image.

Therefore, whether a printer prints directly to paper, as for example in some types of laser thermal printers, inkjet printers, and electrophotographic printers, or uses a transfer process by first printing to an intermediate receiver, such as with the system disclosed in the Harshbarger, et al. patent, there can be significant benefit in sensing characteristics of the paper substrate that will ultimately receive the final printed image. As previously mentioned, while existing prior art methods may provide some level of compensation for paper substrate properties in the printing process, there are drawbacks. As previously mentioned, with the system disclosed in the Harshbarger, et al. patent, the printer apparatus does not write directly to the paper substrate. To properly "tune" the writing operation, it is required that the operator correctly identify the paper substrate type to be ultimately used and employ the correct dot-gain profile that has been designed for that particular type of paper substrate. As stated hereinabove, the operator must manually make adjustments to the laminator apparatus that performs colorant transfer, in order to set speed, pressure and temperature. There is risk of operator error, because these processes require judgment and care when setting-up the printing apparatus to run a proof print.

In addition, the printer disclosed in the Harshbarger et al. patent uses a single laminator apparatus to perform both lamination and image transfer functions. Use of a single device for lamination and image transfer is most readily feasible when lamination material is in sheet form. Also, use of a single device for lamination and image transfer is most readily feasible when the lamination material is in powder form, which occurs, for example, when the laminate is a fine powder similar to toner used in electrophotographic imaging. However, use of a single device for lamination is inappropriate when the laminate is in liquid form.

With other types of printers, an operator may be able to make some type of adjustment based on the paper to be used, such as varying colorant quantity, drying time, fusing time, and fusing temperature. However, correctly making this type of manual adjustment likewise requires a high level of skill and judgment on the part of the printer operator, thereby increasing risk of operator error.

There can also be significant information required about a paper substrate in addition to its color, when such information might be useful in adjusting printer operating parameters. Information regarding variables such as paper surface gloss, thickness, age, grain direction, manufacturer's name, density, and other parameters could be used to adjust a printer for improved performance.

Prepress proofing printers have been adapted to identify types of intermediate media loaded within the printer. A commonly assigned, copending application that provides apparatus for sensing intemediate media in a printer is U.S. Ser. No. 09/133,114 filed Aug. 12, 1998 and titled "A PRINTER WITH MEDIA SUPPLY SPOOL ADAPTED TO SENSE TYPE OF MEDIA, AND METHOD OF ASSEMBLING SAME" and now U.S. Pat. No. 6,099,178, issued on Aug. 8, 2000. Here, the receiver media resides on a spool within the printer and a memory is integrally attached to an RF transponder attached to the spool. The memory stores identifying information concerning a property of the receiver media. The receiver media spool and attached memory are actually loaded inside the marking engine portion of the printer.

Another commonly assigned, copending application that provides apparatus for sensing intermediate media in a printer is U.S. Ser. No. 09/281,595 filed Dec. 22, 1998 and titled "A PRINTER WITH DONOR AND RECEIVER MEDIA SUPPLY TRAYS EACH ADAPTED TO ALLOW A PRINTER TO SENSE TYPE OF MEDIA THEREIN, AND METHOD OF ASSEMBLING THE PRINTER AND TRAYS". Here, the receiver media resides in a supply tray within the printer and a memory is integrally attached to an RF transponder attached to the supply tray. The memory stores identifying information concerning a property of the receiver media residing in the supply tray. The supply tray and attached memory are actually loaded inside the marling engine portion of the printer.

Although U.S. Pat. No. 6,099,178 and U.S. Ser. No. 09/281,595 both disclose use of a memory integrally attached to an RF transponder coupled to receiver media, where the memory stores identifying information about a receiver media property, both of these devices use a memory attached to the receiver media that are actually loaded inside the marking engine portion of the printer. However, with prepress proofing systems, the paper substrate itself may not be loaded in the marking engine, but can receive the image in a separate, subsequent transfer operation. In this subsequent transfer operation, the receiver media serves as an intermediate from which the image is transferred onto the paper substrate. Moreover, the paper substrate itself can be preconditioned, such as by lamination, prior to transfer of the image to the paper substrate. Preconditioning methods and materials can alter surface characteristics of the paper substrate and can affect how the paper substrate responds to the image transfer process, as previously mentioned. For example, a paper substrate from a specific manufactured batch can exhibit different surface characteristics depending on type of prelaminate or how a prelaminate layer is applied. That is, the prelaminate can be applied under various temperature or timing settings. Moreover, color density of a paper that has been preconditioned by lamination can vary, depending on the laminate material used. In light of these differences, the apparatus disclosed in U.S. Pat. No. 6,099,178 U.S. Ser. No. 09/281,595 copending applications do not appear to provide a solution suited to accommodate variable preconditioning of a paper receiver substrate. Therefore, yet another problem in the art is the need to accommodate variable preconditioning required for a paper receiver substrate.

In addition, attachment of a memory to a paper tray, as disclosed in the Ser. No. 09/281,595 copending application, may not be practical or necessary in all cases and may increase cost of printer media as well as printer hardware. In cases where it is only necessary to identify a specific paper, donor, receiver, or laminate material type, use of a memory may not be needed. Other methods for identifying specific paper type and other properties can be used with less expense and complexity. On the other hand, in a case where a substantial amount of information is needed, memory may be a constraint. In such a case, use of a highly structured memory, such as disclosed in the Ser. No. 09/281,595 copending application, can limit the amount of information available from a paper substrate manufacturer. Solutions proposed in copending application Ser. No. 09/281,595 and U.S. Pat. No. 6,099,178 may not easily lend themselves to changes when manufacturers want to add other information to an attached memory. Additionally, it may not be practical for an attached memory to store all possible information describing interactions of a specific paper and a specific preconditioning laminate. For example, media types may have many different manufacture dates. Also, although a manufacturer may be able to provide known information on how different types of media interact in a specific case simply by providing batch numbers and types for a paper substrate and a laminate material at time of manufacture, the solutions noted hereinabove provide no method for obtaining updated and current data on media interaction directly from a manufacturer where such current information would only be available subsequent to the date of manufacture. Thus, another problem in the art is need to obtain current data on media interaction directly from a manufacturer where such information would only be available subsequent to the date of manufacture.

Thus, there has been a long-felt need to provide a printer capable of forming an image on a receiver substrate according to type of receiver substrate, and a method of assembling the printer, in order to detect properties of the receiver substrate, so that preconditioning that has been performed on the receiver substrate is determinable in order to enable the printer to automatically adjust printing operation.

SUMMARY OF THE INVENTION

It is an object of the present invention to provide a printer capable of forming an image on a receiver substrate according to type of receiver substrate, and method of assembling the printer in order to detect properties of the receiver substrate, so that any preconditioning that has been performed on the receiver substrate enables the printer to automatically adjust printing operation accordingly.

With the above object in view, the present invention resides in a printer capable of forming an image on a receiver substrate according to type of receiver substrate, comprising an identifier coupled to the receiver substrate, the identifier containing identifying information uniquely associated with the type of receiver substrate; a sensor disposed in sensing relation to the identifier for sensing the identifying information, so that the type of receiver substrate is identified as the sensor senses the identifying information; and an image marker coupled to the sensor for forming the image on the receiver substrate according to the identifying information sensed by the sensor.

According to an exemplary embodiment of the present invention, the sensor comprises a transceiver capable of transmitting a first electromagnetic field and capable of sensing a second electromagnetic field characteristic of the identifying information. The identifier comprises a transponder capable of receiving the first electromagnetic field transmitted by the transceiver. The first electromagnetic field powers the transponder, which then generates the second electromagnetic field. The second electromagnetic field, characteristic of the identifying information, is sensed by the transceiver. The image marker, which is coupled to the transceiver, forms the image on the receiver substrate according to the identifying information sensed by the transceiver.

According to another exemplary embodiment of the present invention, the sensor comprises a transceiver capable of transmitting a first electromagnetic field containing identifying information concerning the receiver substrate. The identifier comprises a transponder capable of receiving the first electromagnetic field transmitted by the transceiver and storing the identifying information in the transponder for subsequent use. This embodiment of the present invention allows previously stored identifying information that may be residing in the transponder to be updated with different identifying information.

A feature of the present invention is the provision of a transceiver for transmitting a first electromagnetic field to power a transponder which in turn generates a second electromagnetic field characteristic of identifying information associated with a property of the receiver substrate for printing a proof according to the property of the receiver substrate.

Another feature of the present invention is the provision of a transceiver to address a transponder coupled to a receiver substrate and to write identifying information to that transponder, where the data written is indicative of a property of the receiver substrate.

Still another feature of the present invention is the provision of an identifier coupled to a laminate material used to precondition the receiver substrate for printing a proof sheet according to a property of the laminate material.

An advantage of the present invention that use thereof obviates need for manual entry of data describing a receiver substrate. That is, the invention is capable of providing information to an operator or to the printer apparatus itself describing a receiver substrate that is to be used in the printer apparatus.

Another advantage of the present invention that use thereof provides a contactless communication interface, accessing data without requiring that electrical contact be made to corresponding contacts mounted on a receiver substrate supply or in contact with a laminate material supply.

Yet another advantage of the present invention that use thereof allows backward-compatibility with existing receiver substrate supply designs for printers. That is, receiver substrate provided with transponder components can be used in older printers that may not be equipped with the necessary transceiver and logic circuitry that enable use and management of data concerning the receiver substrate. No substantial alteration of external packaging is necessary to implement this invention.

A further advantage of the present invention that, using a networked configuration, it allows a printer to access and use manufacturer information and updates on media properties, when this information becomes available after the manufacturing date of the media.

These and other objects, features, and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

The present description is directed in particular to elements forming part of, or cooperating more directly with, apparatus in accordance with the invention. It is to be understood that elements not specifically shown or described may take various forms well known to those skilled in the art.

For the description that follows, it is instructive first to define the terminology "media". In this regard, the terminology "media" is used herein as a generic term that includes, but that is not limited to, any of the following consumables used by a printer: (1) paper, provided in either sheet or roll form; (2) colorant donor, which can be either laser thermal donor in sheet or roll form, or ink, or toner; (3) intermediate receiver substrate provided in either sheet or roll form; (4) laminate material, which can be provided in sheet or roll form, or as a toner or liquid. The terminology "output receiver substrate" is used herein to include either reflective receiver substrate or transmissive receiver substrate (e.g., transparency) that accepts the final output image. For example, the reflective receiver substrate may be paper, that may optionally be preconditioned and that accepts a final printed image, and the transmissive receiver substrate may be film. However, it may be understood that the receiver substrate may be any suitable material capable of accepting a printed image. The terminology "colorant source" is used herein to mean the source medium from which the final image, in the form of a donor colorant, is transferred onto the receiver substrate. For a printer that writes directly to the output receiver substrate, the colorant source may be thermal donor media, ink, pigment, dye, or toner. Note that for a printer that employs an intermediate receiver substrate, the intermediate receiver substrate is the colorant source that deposits the image on the output receiver substrate.

As described in more detail hereinbelow, the present invention comprises first, second and third embodiments of image forming or printers that transfer an image from the colorant source to a receiver substrate. For a printer that writes directly to the output receiver substrate, the printer includes an image marker. For a prepress printer that employs an intermediate receiver substrate, the printer includes an image transfer apparatus.

Figure 1:
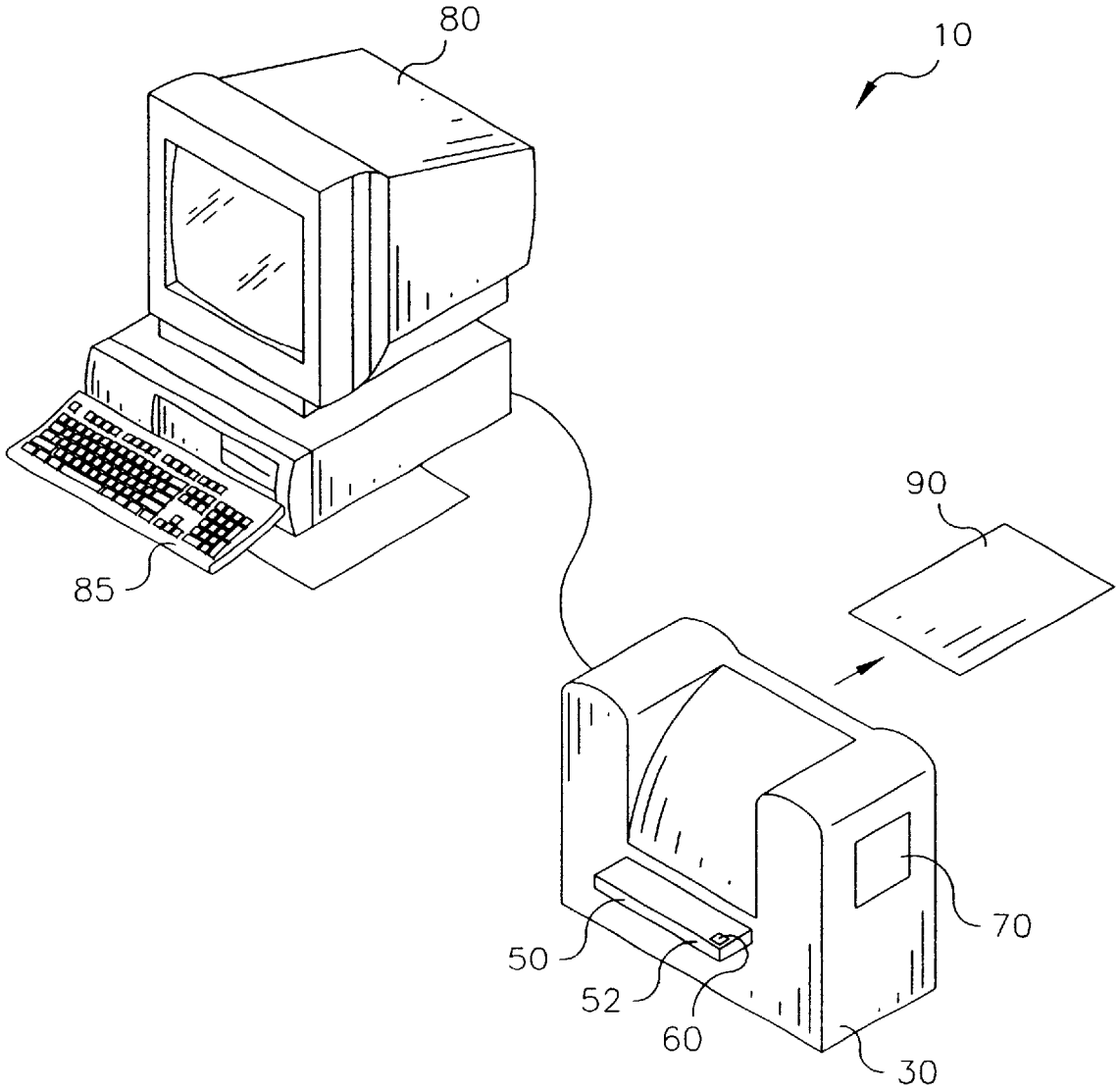
FIG. 1 is a view in perspective of a first embodiment printer capable of forming an image on a receiver substrate according to type of receiver substrate.

Referring to FIG. 1 there is shown a first embodiment printer, generally referred to as 10, adapted for sensing properties of a receiver substrate 20. Printer 10 transfers an image from a colorant source to an output a receiver substrate 20. For a printer that writes directly to receiver substrate 20, printer 10 includes an image marker 30, as described in more detail hereinbelow. A receiver substrate supply 50 contains a supply of receiver substrate 20 in sheet or roll form. When receiver substrate 20 is in sheet form (as shown), receiver substrate 20 resides in a supply tray 52. Supply tray 52 has an identifier 60 integrally attached thereto that identifies properties of receiver substrate 20 loaded in supply tray 52. For reasons disclosed more fully hereinbelow, there may be a plurality of identifiers 60*a*/60*b*/60*c*/60*d* (see FIG. 5).

Still referring to FIG. 1, a sensor or reader 70, belonging to printer 10, reads identifier 60 to determine identifying information concerning receiver substrate 20. The identifying information includes properties of receiver substrate 20. For reasons disclosed more fully hereinbelow, there may be a plurality of identifiers 70*a*/70*b*/70*c* (see FIG. 5). As shown in FIG. 1, printer logic control, carried out by a computer 80 (or, alternately, by comparable control logic circuitry internal to printer 10), communicates with reader 70 to obtain information from identifier 60. Based on information obtained from identifier 60, computer 80 adapts the operation of printer 10 for printing on the type of receiver substrate 20 loaded into image marker 30 from receiver substrate supply 50 in order to create a printed output sheet 90. Alternatively, identifier information may be input to computer 80, and thus input to printer 10, by means of a keyboard 85, if desired. There are a number of ways to implement identifier 60 and reader 70 and to attach identifier 60. For example, identifier 60 could simply consist of an identification code that is written on a label, so that the operator manually enters the label information to computer 80, using keyboard 85. No reader 70 would then be needed for the simplest use of the present invention.

Figure 2:
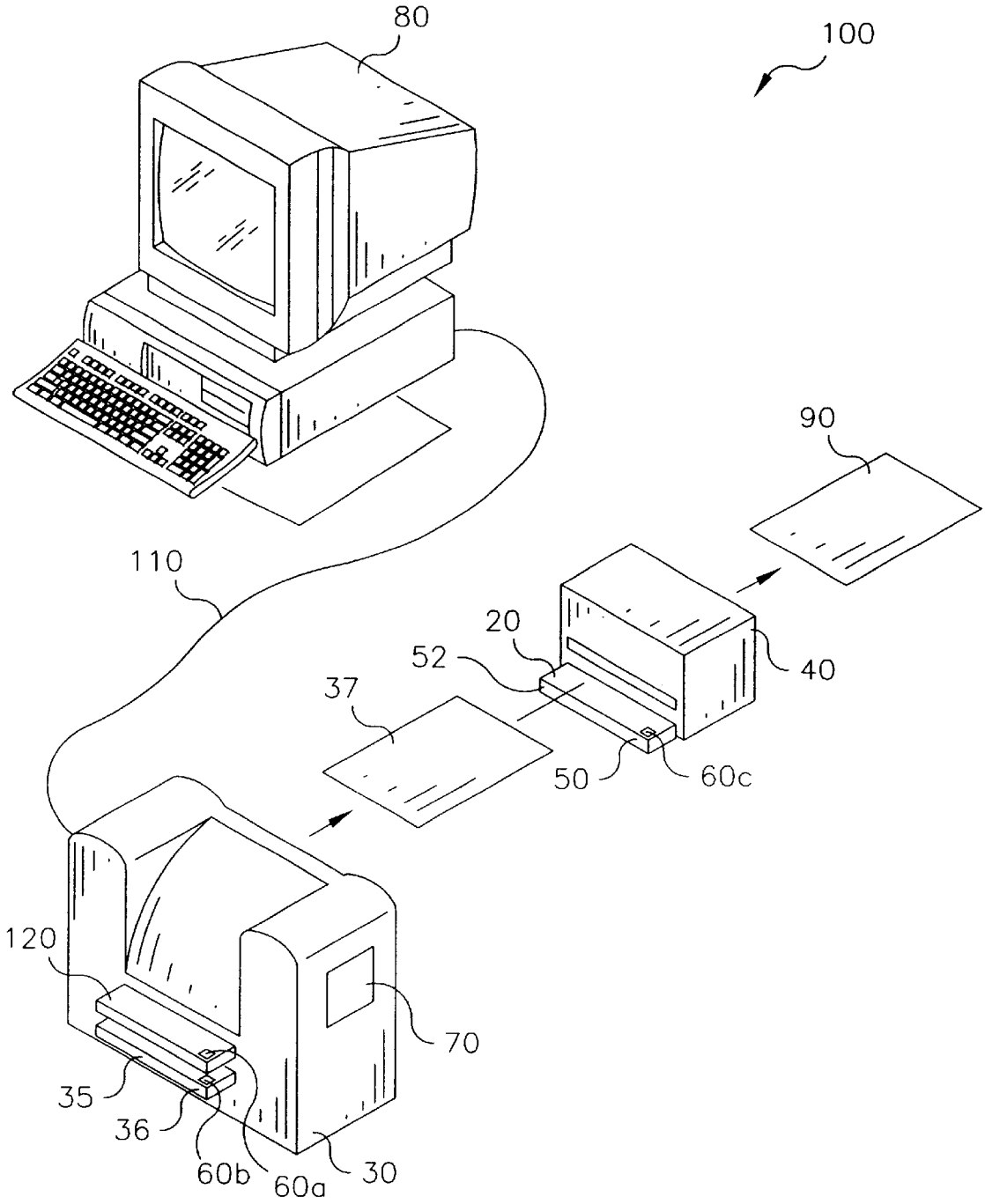
FIG. 2 is a view in perspective of a second embodiment printer in the form of a prepress laser thermal printer capable of forming an image on a receiver substrate according to type of receiver substrate.

Referring to FIG. 2 there is shown a second embodiment printer, generally referred to as 100, likewise adapted for sensing properties of receiver substrate 20. This second embodiment printer 100, which is a prepress laser thermal printer, also transfers an image from a colorant source to receiver substrate 20. Prepress printer 100 comprises both image marker 30 that selectively places colorant defining a donor material from a donor supply 35 onto an intermediate receiver substrate 37, and the image transfer apparatus 40, that transfers the image from intermediate receiver substrate 37 onto receiver substrate 20 from receiver substrate supply 50 to provide printed output sheet 90. Donor supply 35 may be a supply of cut sheets of donor residing in a donor supply tray 36. In addition, intermediate receiver substrate 37 may comprise cut sheets of intermediate receiver residing in supply tray 38. Image transfer apparatus 40 serves as an image forming apparatus for prepress printer 100. As disclosed more fully immediately hereinbelow, second embodiment printer 100 is adapted for sensing properties of receiver substrate 20 loaded therein. In this regard, reader 70, which is connected to computer 80 by means of a data link 110, reads identifier 60*c* mounted on receiver substrate supply 50. An intermediate receiver supply 38 comprises identifier 60*a*, that identifies intermediate receiver properties. Intermediate receiver supply 38 is used as the colorant source for printer 100. Additionally, donor supply 35 comprises identifier 60*b* that identifies donor type.

Figure 3:
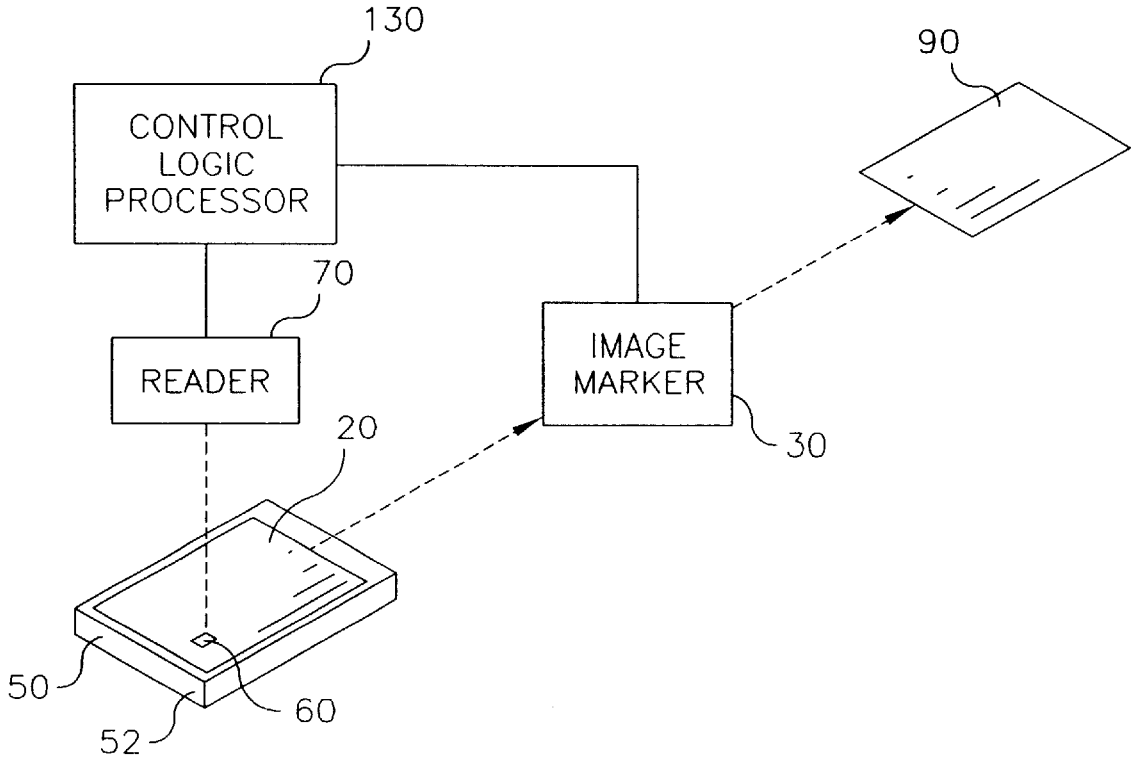
FIG. 3 is a schematic block diagram showing functional relationships between components disposed within the first or second embodiment printers.

Referring to FIG. 3, there is shown a schematic functional diagram illustrating functional relationships between components that adapt printers 10 and 100 to sense receiver substrate 20 properties in accordance with the present invention. In this regard, reader 70 communicates with a control logic processor 130 and reads identifier 60. Operation of control logic processor 130 may be implemented using computer 80, if desired. By way of illustration, and not by way of limitation, identifier 60 and corresponding reader 70 may be any pair of the components listed in Table 1 hereinbelow.

TABLE 1

Exemplary Listing of Identifier 60 And Corresponding Reader 70 Components

| Identifier 60: | Paired with Corresponding Reader 70: |
|---|---|
| Bar code, or other optically encoded representation | Bar code reader |
| Label, intended for reading or for scanning | None, if label data is manually entered by an operator. Optical Character Recognition (OCR) scanner if intended for automated scanning. |
| Magnetically encoded strip | Magnetic strip reader |
| Trace pattern, such as an embedded trace pattern | Trace pattern reader |
| Transponder, such as an RF transponder. | Transceiver, such as an RF transceiver. |

Reader 70 may be any of several standard devices well known in the sensing art. For example, the identifier/reader pair may be a transponder/transceiver pair, as described hereinbelow.

Figure 4:
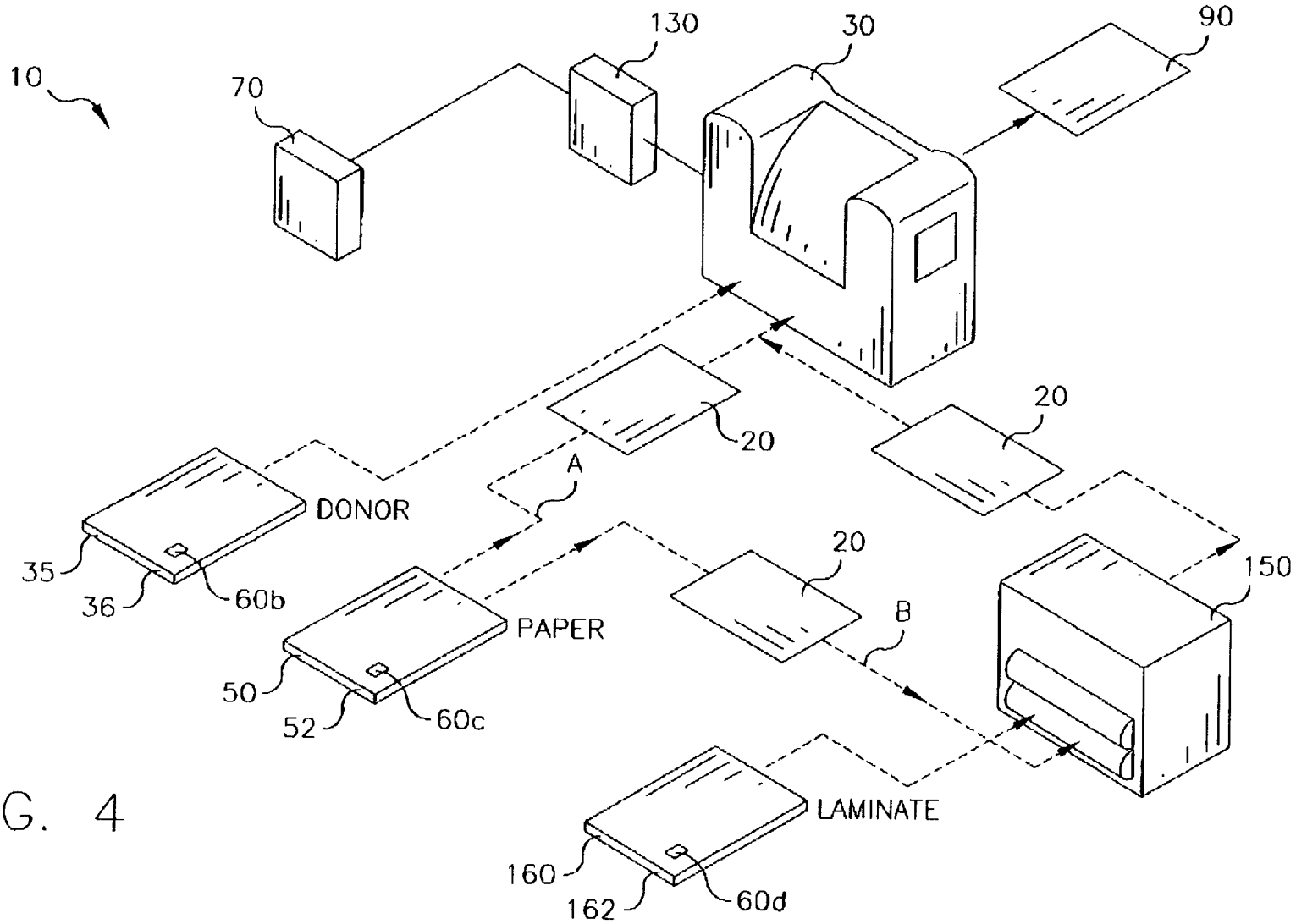
FIG. 4 is a schematic block diagram showing functional relationships between printer components and the overall process where an image marker transfers colorant from a donor sheet onto an output receiver substrate.

FIG. 4 shows a functional block diagram representation illustrating functional relationships between printer 10 components and the overall printing process that ends when an image marker 30 transfers colorant from a donor medium directly onto receiver substrate 20. Printer 10 includes image marker 30. According to the preferred embodiment, receiver substrate 20, which may be a paper sheet, can take one of two paths. Using the simplest path, marked by dotted line A, receiver substrate 20 from receiver substrate supply 50 can be directly input to image marker 30 along with a sheet of donor from a donor supply 35. Donor supply 35 can be in either sheet or roll form. When in sheet form, donor supply 35 resides in donor supply tray 36. Or, using the alternate path indicated by dotted line B, receiver substrate 20 from receiver substrate supply 50 can be preconditioned. In path B, receiver substrate 20 is input to a paper conditioning component 150. Paper conditioning component 150 may be a laminator apparatus that applies a laminate coating to the surface of receiver substrate 20. In this case, a laminate supply 160 provides laminate material for creating a laminate layer 165 (see FIG. 9) where laminate material may be in any one of a number of forms, including sheet form, powder form, or a liquid. When in sheet form, laminate supply 160 resides in a laminate supply tray 162. As shown in FIG. 4, paper conditioning component 150 applies the laminate material to receiver substrate 20, prior to image transfer. This creates receiver substrate 20 (see FIG. 9). As shown in FIG. 4, receiver substrate 20 is then provided as input to image marker 30. Previously mentioned reader 70 then reads at least one of identifiers 60*c* for paper, 60*b* for donor, or 60*d* for laminate. Control logic processor 130 (typically embodied as computer 80) adjusts the operation of image marker 30 based on at least one of the sensed paper properties, donor properties, or laminate material properties, as the case may be. Printed output sheet 90 is then provided as output from image marker 30.

Figure 5:
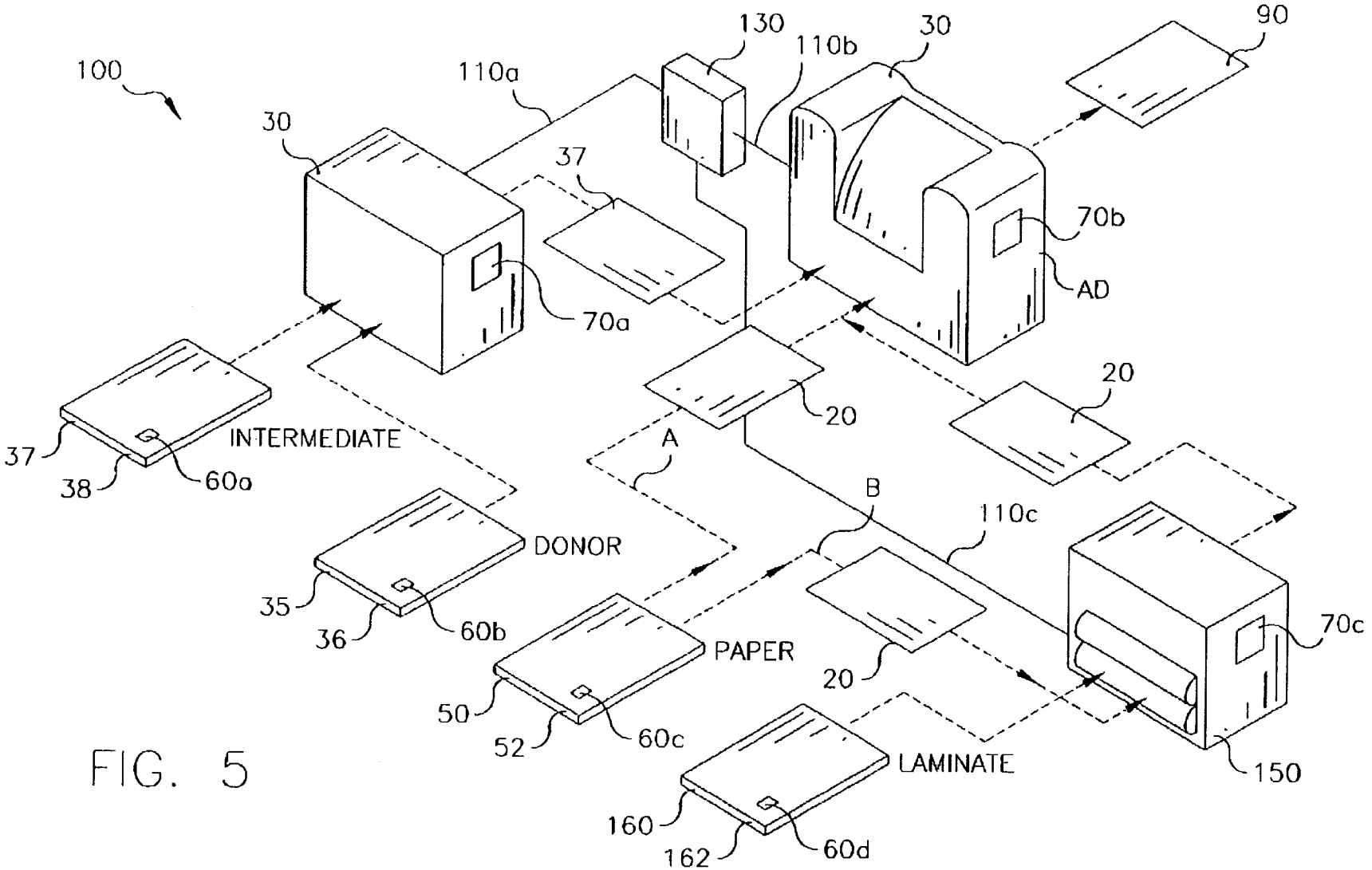
FIG. 5 is a schematic block diagram showing functional relationships of printer components and the overall process where an image marker transfers colorant from a donor sheet onto an intermediate receiver substrate, this schematic block diagram also showing an image transfer apparatus that transfers the image from the intermediate receiver substrate onto the output receiver substrate.

FIG. 5 is a block diagram illustrating functional relationships of printer 100 components and the overall process whereby image marker 30 transfers colorant from a donor onto an intermediate receiver substrate 37, then image transfer apparatus 40 transfers the image from intermediate receiver substrate 37 onto receiver substrate 20. Image transfer apparatus 40 serves as the image forming apparatus. Intermediate receiver substrate 37 is prepared by image marker 30 using a receiver sheet from intermediate receiver supply 38 and colorant donor media from donor supply 35. Receiver substrate 20 can take one of two paths. Using the simplest path, marked by dotted line A, receiver substrate 20 from receiver substrate supply 50 is directly input to image transfer apparatus 40. Or, using the alternate path indicated by dotted line B, receiver substrate 20 from receiver substrate supply 50 can be preconditioned. In path B, receiver substrate 20 is input to paper conditioning component 150. Paper conditioning component 150 may be a laminator apparatus that applies a laminate layer 165 to the substrate surface (see FIG. 9). Laminate supply 160 provides laminate material in a number of forms, including sheet form, powder form, or a liquid. Paper conditioning component 150 applies laminate layer 165 to receiver substrate 20 to generate receiver substrate 20. Receiver substrate 20 is then provided as input to image transfer apparatus 40.

Still referring to FIG. 5, at least one of a plurality of sensors or readers 70*a*, 70*b*, or 70*c* reads respective ones of identifier 60*a* associated with intermediate receiver [170] 37, identifier 60*b* associated with colorant donor [140] media from donor supply 35, identifier 60*c* associated with receiver substrate 20, or identifier 60*d* associated with laminate 160. Readers 70*a*/*b*/*c* communicate with control logic processor 130 by means of respective ones of a plurality of data links 110*a*/*b*/*c*, implemented, for example, using an RS-232C serial connection. Control logic processor 130 (typically embodied as computer 80) adjusts the operation of at least one of image market 30, image transfer apparatus 40, or paper conditioning component 150 based on at least one of the sensed receiver substrate 20 type, donor media 35, intermediate media 37, or laminate material type 160. Printed output sheet 90 is then provided as output from image transfer apparatus 40.

Referring to FIGS. 4 and 5, it should be understood from the description hereinabove, that paper conditioning component 150 and image transfer apparatus 40 both typically apply a combination of heat and pressure in a controlled manner. Heat and pressure are applied to precondition receiver substrate 20 in paper conditioning component 150 and to transfer the image from intermediate receiver substrate 37 in image transfer apparatus 40. This configuration of the present invention allows laminate to be applied in liquid form for creating laminate layer 165.

It should be noted that FIGS. 4 and 5 depict donor supply 35 and laminate supply 160 in sheet form. However, it should be understood from the teachings hereinabove that the same overall processing sequence and interrelationship of components would apply where either or both donor and laminate are in roll form. The same overall sequence and interrelationship would also apply where donor supply 35 comprises an ink or toner colorant. Likewise, the same overall sequence and interrelationship apply where laminate supply 160 comprises a toner or a liquid.

Using the arrangement of components shown in FIGS. 4 and 5, control logic processor 130, based on data from one or more of readers 70*a*, 70*b*, or 70*c*, can adjust the operation of image marker 30, image transfer apparatus 40, and paper conditioning component 150 in a number of ways. For a laser thermal printer, operation of image marker 30 can be adjusted by varying the amount of exposure energy applied in order to affect density. For an inkjet printer, operation of image marker 30 can be adjusted by varying the amount of ink applied and the drying time. For an electrophotographic printer, operation of image marker 30 can be adjusted by varying the amount of toner applied and fusing temperature and timing. For image transfer apparatus 40 and paper conditioning component 150 using heat and applied pressure, operation can be adjusted by varying temperature or by varying applied pressure, such as by controlling the distance between rollers or using some variable pressure mechanism. Operation also can be adjusted by varying time during which pressure and temperature are applied, such as by controlling roller speed. To adjust operation of a paper conditioning component 150 that applies a liquid, drying time or coating thickness may be varied.

A computer program running on control logic processor 130 can thereby adjust the operation of printer 10 or printer 100 based on identifier 60*a*/*b*/*c*/*d* data, using techniques well known in the computer programming art. In a simple form, merely identifying the properties of receiver substrate 20, donor, or laminate media loaded in printers 10/100 can be used by control logic processor 130 to make corresponding adjustments. It should be noted that the capability of control logic processor 130 to adapt flexibly to possible variations in media properties and in media characteristics is, in part, a function of how much information about the media can be provided by identifiers 60*a*/*b*/*c*/*d*. The benefits of providing substantial information about each media loaded in printers 10/100 can be readily appreciated. Use of the present invention provides as much information as is possible concerning media loaded in printers 10/100. By providing a substantial amount of information to control logic processor 130, the present invention allows a significant amount of latitude for control logic processor 130 in adjusting operation of printers 10/100 for optimal performance.

Figure 6:
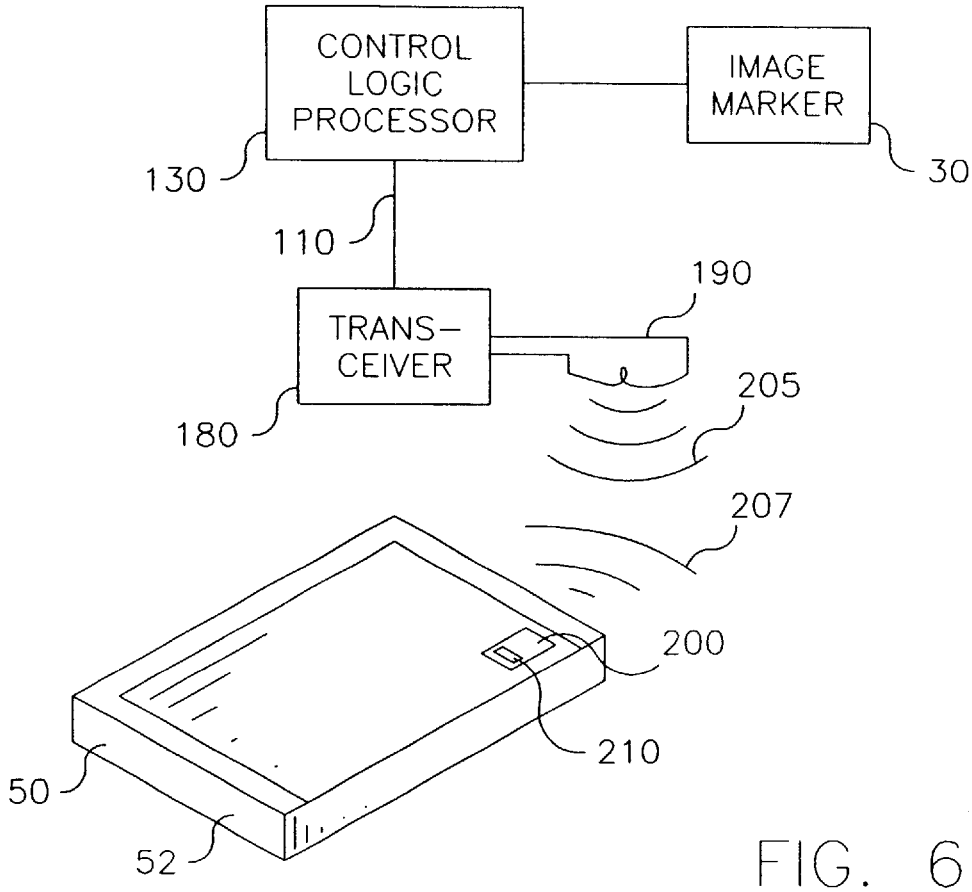
FIG. 6 is a schematic block diagram showing interaction of an identifier and a sensor device.

Referring to FIG. 6 there is shown, in block diagram form, an aspect of the present invention comprising components for reader 70 and identifier 60. In this regard, reader 70 may be a transceiver 180 that is connected to an antenna 190. A transponder 200, configured as described presently, serves the function of previously mentioned identifiers 60/60*a*/60*b*/60*c*/60*d*. Transponder 200 is integrally connected to, or merely disposed within, at least one of receiver substrate supply 50, intermediate receiver supply 38, donor supply 35, or laminate supply 160. Transceiver 180 may be,an RF transceiver, such as a "Model S2000"™ transceiver, available from Texas Instruments, Incorporated, located in Dallas, Tex., USA. Alternatively, transceiver 180 may be a "Model U2270B"™ transceiver, available from Vishay-Telefunken Semiconductors, Incorporated, located in Malvern, Pa., USA. Antenna 190 is disposed so as to be in a suitable position for reading transponder 200.

Still referring to FIG. 6, transceiver 180 is capable of transmitting a first electromagnetic field 205 of a first predetermined frequency, for reasons disclosed presently. Transceiver 180 is also capable of receiving a second electromagnetic field 207 of a second predetermined frequency, for reasons disclosed presently. Typically, the same frequency serves for both first and second electromagnetic fields 205 and 207.

Referring yet again to FIG. 6, transponder 200 may be an RF transponder, such as an "SAMPT" Selective Addressable Multi-Page Transponder), part number "RI-TRP-IR2B" available from Texas Instruments, Incorporated. Alternately, transponder 200 may be a "Model TL5550"™ transponder, available from Vishay-Telefunken Semiconductors, Incorporated. Especially advantageous for attachment to consumable paper or film sheet material, a low-profile device such as a "TAG-IT Inlay"™ available from Texas Instruments, Incorporated may alternately be used as transponder 200.

Again referring to FIG. 6, transponder 200 is preferably a low-power device that derives its source power from the first electromagnetic field 205 emitted by transceiver 180. By way of example only, and not by way of limitation, transponder 200 may be generally cylindrical, smaller than 4 mm in diameter and less than 32 mm in length. This allows transponder 200 to be compact and thus easily attached to a supply tray or other supply container.

The present invention allows for a number of possible arrangements of transceiver 180 in printers 10/100. It would be possible, for example, for a single transceiver 180 to communicate using multiple antennae 190. An antenna 190 could be housed in any of image marker 30, image transfer apparatus 40, or paper conditioning component 150, and be connected to transceiver 180 either singly or, where multiple antennae 190 are used, by means of a multiplexing switch (not shown), using connection and switching techniques well known in the electronic arts. Alternate possible connection schemes for addressing individual transponders 200 include use of a plurality of microreader modules, such as a "RI-STU-MRD1 Micro-reader"™ available from Texas Instruments, Incorporated. Using this scheme, a microreader module would be disposed within printers 10/100 near the location of each transponder 200 to identify each media type.

Transceiver 180, which is intended for identifier application, typically operates over a limited distance, for example, within a few feet of transponder 200. Where multiple transponders 200 are all within range of a single transceiver 180, it would be possible to employ a "non-collision" algorithm for communicating with multiple transponders 200 grouped in a confined area. Briefly, this algorithm works by using a computational loop that proceeds in steps to increase transceiver 180 output power from an initial low value as transceiver 180 repeatedly polls for a desired transponder 200. As soon as it detects the desired transponder 200, transceiver 180 communicates with that transponder 200, then temporarily disables the desired transponder 200. Transceiver 180 then repeats polling, incrementing its RF output power level slightly with each polling operation, to locate, communicate with, and then temporarily disable the next desired transponder 200. In this way, transceiver 180 serially communicates with multiple transponders 200 in order of their return signal strength, until all transponders 200 have been polled.

Transceiver 180 can be electrically coupled to control logic processor 130, such as by means of data link 110 using a standard interface. This interface may be, for example, a RS-232C serial connection. This arrangement allows transceiver 180 to be 10 mounted or placed within printers 10/100 at any convenient location, thereby allowing retrofit of printers by including transceiver 180, along with any multiplexing switch and antennae 190. This, of course, allows upgrading of any existing printers.

It is instructive to disclose how transceiver 180 communicates with transponder 200 which is disposed within printers 10/100. In this regard, transponder 200 is tuned to the carrier frequency (typically an RF frequency) emitted by transceiver 180. Upon receiving an initial frequency signal from transceiver 180, circuitry of transponder 200 obtains, from the emitted electromagnetic energy, sufficient energy to provide source voltage for its internal circuitry. Thus, no battery is needed to separately power transponder 200.

Moreover, as shown in FIG. 6, each transponder 200 is integrally coupled to a memory 210. Each transponder 200 is individually programmed with an unique identifying address code (ID), stored in memory 210. As a final stage in manufacture, transponder 200 is programmed to store its ID in memory 210 along with other data that is characteristic of the corresponding media type to which it is attached (i.e., receiver substrate 20, intermediate receiver, donor, or laminate). In the preferred embodiment, transponder 200 is integrally assembled with the media, but does not require programming until assembly is complete. This obviates the need to track the media with its corresponding transponder 200 during manufacture.

In the preferred embodiment of the present invention, transceiver 180 has both read and write access to data in memory 210 of transponder 200. As will be described presently, this allows transponder 200 to store and update useful information on actual usage and processing in addition to currently stored information regarding manufacture of the media.

To communicate with an individual transponder 200, transceiver 180 encodes the unique identifying address code as part of its emitted signal, along with a command to read data from or to write data to (i.e., "program") memory 210 in transponder 200. Transponder 200 responds to transceiver 180 communication only when it has been addressed correctly. This mechanism allows transceiver 180 to specifically address an individually selected transponder 200 and helps to avoid interference signals from a nonselected nearby transponder 200 that otherwise might be unintentionally activated by the received signal from transceiver 180.

In addition to selective addressing, there are other data security options available with the SAMPT device used for transponder 200. Individual blocks or "pages" in memory 210 can be separately locked to prevent inadvertent overwriting of stored data. Commands are available to allow access to individual pages only, so that transceiver 180 can be permitted to read or write only specific data from memory 210 that is connected to transponder 200.

Figure 7:
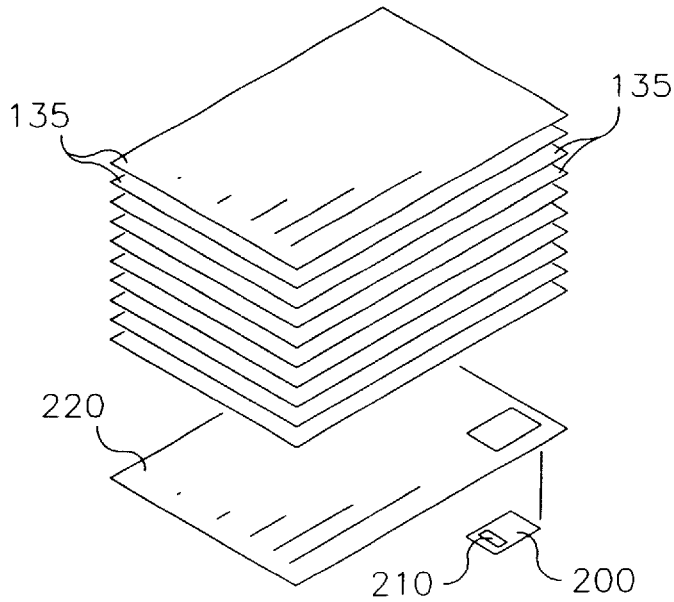
FIG. 7 is an exploded view showing placement of an identifier on a receiver substrate supply.

Turning now to FIG. 7, a method of attachment of transponder 200 to receiver substrate supply 50 will be described. Transponder 200 may be the previously mentioned low-profile, "TAG-IT Inlay"™ type transponder, allowing transponder 200 to be taped onto a backer sheet 220 that is provided with the receiver substrate (e.g., paper) packaging. When a stack of paper sheets 135 are loaded into receiver substrate supply 50, backer sheet 220 is used to support the stack of paper sheets 135 for loading and is retained in receiver substrate supply 50 as the stack of paper sheets 135 is fully consumed. Or, each receiver substrate 20 can include an attached miniaturized transponder 200. A similar arrangement may be used for attachment of transponder 200 to intermediate receiver supply 38, to donor supply 35 (when donor is provided in sheet form), or laminate supply 160 (when laminate is provided in sheet form).

It may be appreciated from the description hereinabove, that alternate arrangements are possible for attaching or including transponder 200 within receiver substrate supply 50, intermediate receiver supply 38, donor supply 35, or laminate supply 160. For example, where a disposable tray is used, transponder 200 can be taped or glued to the tray structure at manufacture, suitably disposed for reading by transceiver 180 when the tray is loaded. For donor or laminate media provided in powder or in liquid form, transponder 200 may be attached to the outside of the container holding the donor or laminate media. Alternately, transponder 200 may even be inserted within a donor or laminate container, provided that the container is made of plastic or other material transparent to electromagnetic radiation in order to allow passage of the electromagnetic frequency signal. Where the media is provided in roll form, transponder 200 can be integrally connected to or inserted within a supporting internal core about which the media is wound.

By way of example only and not by way of limitation, data stored in memory 210 that is attached to receiver substrate supply 50 may be any of the exemplary data displayed in Table 2 hereinbelow.

TABLE 2

Properties Data Stored in Memory 210 for Receiver substrate supply 50

| Data Stored (Paper Property) | Number of Bits | Description |
|---|---|---|
| Paper Type Identifier | 168 | A 21-character field encoding the type of paper (by distinctive trade name, e.g. "TextWeb".) |
| Product Code | 40 | 10-digit product code. (May not be required if Paper Type Identifier field provides enough data.) |
| Catalog Number | 32 | Encoded catalog number. For example, 122 4355. |
| Manufacture Date | 16 | 16-bit encoded date. Includes 4-bit month, 5-bit day, 7-bit year components. |
| Paper Properties | 256 | Encoded data on surface coating/finish, thickness, weight, grain direction, stretching coefficients, gloss, texture, pH, absorbency. |
| Density and Related Data | 128 | Encoded parameter values allowing characterization of paper density and related sensitometric values, including RGB density, transmission/reflectance spectrum data, L*a*b* measurements. |
| Usage Level/ Sheet Count | 32 | Where memory 210 is read/write. For sheet form: 32-bit value indicating number of sheets removed from receiver substrate supply 50. For roll form: length of roll remaining. |
| Dimensions | 16 | For sheets: height and width of sheet. For roll: width of roll. |

As Table 2 shows, data included in memory 210 for the receiver substrate supply can include both data from manufacture (written to memory 210 at the factory) and/or data describing usage (written to memory 210 and updated based on number of prints created). Having both read/write access to memory 210 for any media type allows control logic processor 130 to track media usage for any or all media used by printers 10/100. This would allow control logic processor 130 to provide an operator message (such as on computer 80) to warn an operator of a low-media condition for any media type. This capability of the present invention advantageously identifies the situation where one type of media is substituted for another. For example, a prepress production shop may have multiple trays for receiver substrate supply 50, each tray holding a different receiver substrate type, where only one tray can be loaded at a time in printers 10/100. Usage data could thereby be retained on each receiver substrate tray, even when different trays are used and even when these trays are removed or replaced in printers 10/100 as needed during production runs.

By way of example only and not by way of limitation, data stored in memory 210 that is attached to laminate supply 160 may be any of the exemplary data displayed in Table 3 hereinbelow.

TABLE 3

Properties Data Stored in Memory 210 for Laminate Supply 160

| Data Stored | Number of Bits | Description |
|---|---|---|
| Laminate Type Identifier | 168 | A 16-character number encoding the type of laminate (for example "1234567590123456") |
| Product Code | 40 | 10-digit product code. (May not be required if Laminate Type Identifier field provides enough data.) |
| Catalog Number | 32 | Encoded catalog number. For example, "167 4775". |
| Manufacture Date | 16 | 16-bit encoded date. Includes 4-bit month, 5-bit day, 7-bit year components. |
| Laminate Properties | 256 | Encoded data on surface coating/finish, thickness, weight, material type, stretching coefficients, gloss, texture. For a laminate provided in liquid form, may include viscosity, binder composition, pH value. For a laminate provided in particulate form, may include particle size, optimum fusing temperature. |
| Density and Related Data | 128 | Encoded parameter values allowing characterization of laminate density and related sensitometric values, including RGB density, transmission/reflectance spectrum data, L*a*b* measurements. |
| Usage Level/ Sheet Count | 32 | 32-bit value indicating usage level. Can be updated by reader 70 (when memory 210 is read/write) to indicate number of sheets remaining in laminate supply 160. For roll form, can indicate length remaining. For liquid or toner form, can indicate amount of material remaining (by number of sheets). |
| Dimensions | 16 | For laminate in sheet form: height and width of sheet. For roll form: width of roll. |

Moreover, by way of example only and not by way of limitation, data stored in memory 210 that is attached to donor supply 35 may be any of the exemplary data displayed in Table 4 hereinbelow.

TABLE 4

Properties Data Stored in Memory 210 for Donor Supply 35

| Data Stored | Number of Bits | Description |
|---|---|---|
| Donor Type Identifier | 168 | A 16-character number encoding the type of donor (for example "3234563598763453") |
| Product Code | 40 | 10-digit product code. (May not be required if Donor Type Identifier field provides enough data.) |
| Catalog Number | 32 | Encoded catalog number. For example, "167 8871". |
| Manufacture Date | 16 | 16-bit encoded date. Includes 4-bit month, 5-bit day, 7-bit year components. |

TABLE 4-continued

Properties Data Stored in Memory 210 for Donor Supply 35

| Data Stored | Number of Bits | Description |
|---|---|---|
| Donor Physical Properties | 256 | Encoded data on donor physical properties. For donor in film form: sheet thickness, sheet dimensions, film base type. For donor in ink form: ink viscosity, ink chemical composition, surface tension, solvent concentration, colorant, binder, and additive usage, absorption properties. For donor in particulate (toner) form, may include particle size, optimum fusing temperature. |
| Density and Related Color | 128 | Encoded parameter values allowing characterization of donor color, mean donor density and related sensitometric values, including RGB density, transmission/ reflectance spectrum data, L*a*b* measurements, gamut-mapping data. |
| Usage Level/ Sheet Count | 32 | 32-bit value indicating usage level. Can be updated by reader 70 (when memory 210 is read/write) to indicate number of sheets remaining in donor supply 35. For roll form, can indicate length remaining. For ink or toner form, can indicate amount of ink or toner remaining, based on number of sheets printed or use other measurement of actual usage. |

In addition, by way of example only and not by way of limitation, the properties data stored in memory 210 that is attached to intermediate receiver supply 38 may be any of the exemplary data displayed in Table 5 hereinbelow.

TABLE 5

Properties Data Stored in Memory 210 for Intermediate Receiver Supply 38

| Data Stored | Number of Bits | Description |
|---|---|---|
| Receiver Type Identifier | 168 | A 16-character number encoding the type of receiver (for example "5534555598765553") |
| Product Code | 40 | 10-digit product code. (May not be required if Receiver Type Identifier field provides enough data.) |
| Catalog Number | 32 | Encoded catalog number. For example, "997 3334". |
| Manufacture Date | 16 | 16-bit encoded date. Includes 4-bit month, 5-bit day, 7-bit year components. |
| Receiver Physical Properties | 256 | Encoded data on receiver physical properties, such as mean sheet thickness, sheet dimensions, film base type, focus position adjustment. |
| Density and Related Color | 128 | Encoded parameter values allowing characterization of density and related sensitometric values for intermediate receiver, including colorant receptivity and transfer parameters, density contribution from fusing process. |
| Usage Level/ Sheet Count | 32 | 32-bit value indicating usage level. Can be updated by reader 70 (when memory 210 is read/write) to indicate number of sheets remaining in intermediate receiver supply 38. For roll form, can indicate length remaining. |

With regard to identification sequencing for the media to be used in printers 10/100, power-up initialization of printers 10/100 includes a polling sequence in which readers 70, 70*a*, 70*b*, and 70*c* successively poll identifiers 60, 60*a*, 60*b*, 60*c*, and 60*d* to obtain information regarding properties of media to be loaded in printers 10/100. The control program running in control logic processor 130 stores this media information (as exemplified in Tables 2-5) in a computer memory (not shown). When a printing operation is initiated, control logic processor 130 adjusts the operation of one or more of image marker 30, image transfer apparatus 40, and paper conditioning component 150 to provide the desired output print.

When a different media is loaded at any time after power-up printers 10/100, a re-read of at least the corresponding identifier 60/60*a*/*b*/*c*/*d* is initiated. Sensors, such as microswitches (not shown) or other conventional sensors well known in the sensing art, can be used to indicate removal or replacement of receiver substrate supply 50, intermediate receiver supply 38, donor supply 35, or laminate supply 160 and initiate a re-read at that time. In the preferred embodiment using transceiver 180 and transponder 200, a re-read of identifiers 60*a*/*b*/*c*/*d* is initiated at the start of each print job. This obviates the need for sensors to detect removal/reinsertion of media supplies and provides an accurate method for obtaining current status on media loaded in printers 10/100.

Figure 8:
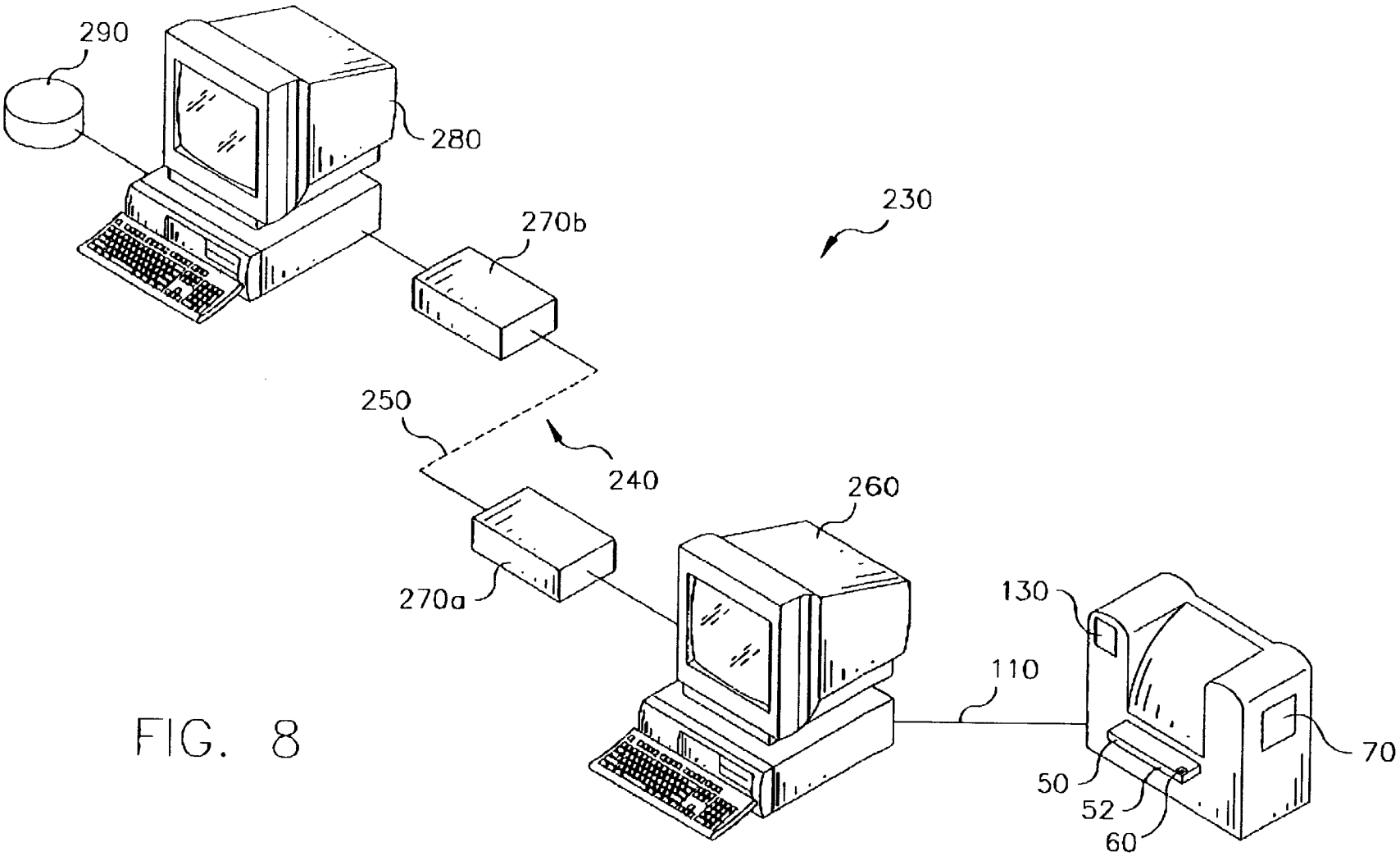
FIG. 8 is a view in perspective of a third embodiment of the present invention showing printer components having a network connection to a remote data source in order to access remotely stored information concerning the intermediate or output receiver substrate.

Referring to FIG. 8, there is shown a third embodiment of the present invention, comprising a remote access printer, generally referred to as 230, for allowing remote information access. In this regard, it is often advantageous for control logic processor 130 to have access to media-related information directly from a media manufacturer. For example, such media-related information may include image processing information related to using a specific batch of paper, laminate material,. donor, or intermediate receiver. To this end, printer 230 comprises a remote network access, generally referred to as 240. Network access 240 includes a telecommunications link 250 for reasons disclosed hereinbelow.

Referring again to FIG. 8, printer 230 is connected to an intermediary networked server 260 that communicates with control logic processor 130 over standard data link 110 interface, such as a RS 232C serial connection. Networked server 260 may be any of a number of standard computer platforms known in the art, such as a personal computer (as shown) configured for Internet connection. Telecommunications link 250 may be any of a number of connections well known in the art. For example, telecommunications link 250 may be implemented using a standard Internet connection. In this regard, telecommunications link 250 may include a telephone line by which a first modem 270*a* (modulator/demodulator) connects networked server 260 to the telephone line for Internet access. First modem 270*a* itself may be a separate, free-standing device or integrally incorporated into networked server 260. Moreover, telecommunications link 250 need not be a telephone line; rather, telecommunications link 250 may be formed of electromagnetic waves broadcast by networked server 260 at one or more predetermined frequencies.

Of course, not shown in FIG. 8 are "black box" components, well-known in the art, by which an Internet provider utility provides connection service, including any other features necessary, such as firewalls for data security. Because such a system is substantially "hidden" to the Internet user, FIG. 8 necessarily represents all possible implementations of Internet service connection.

Referring yet again to FIG. 8, printer 230 further includes a host computer 280 coupled to telecommunications link 250, such as by means of second modem 270*b*. Host computer 280 may be located at the site of the media manufacturer or at the site of the manufacturer of printer 230 components and contains computer software logic and data access capabilities for accepting media identifier information from remotely located networked servers 260. Based on this identifier information, host computer 280 returns processing information to control logic processor 130 on the specific media types loaded in printer 230. Host computer 280 can be any of a number of known workstation computer platforms, including but not limited to, a suitably configured personal computer or "UNIX"™-based workstation.

As illustrated in FIG. 8, host computer 280 is capable of accessing a media information data source 290 that contains detailed test and performance measurements and manufacturing data on each batch of output receiver substrate 20, intermediate receiver substrate 37, donor 35, or laminate media 160. Data source 290 may be stored on host computer 280 or stored on a separate "UNIX"™-based workstation (not shown) running suitable database management software, which software may be, for example, "ORACLE Database"™ software available from Oracle Corporation, located in Redwood Shores, Calif., U.S.A.

As stated hereinabove, and with reference to FIG. 8, networked access 240 may include an Internet connection. In this regard, a standard HTTP Hypertext Transfer Protocol) control is employed to provide 2-way communication between remote host computer 280 and networked server 260. This configuration of the present invention allows use of conventional "browser" utilities and user interfaces well-known in the telecommunications art. In this case, networked server 260 is accessed by means of its assigned HTTP address. Download of data to networked server 260 in the form of a digital file is performed by remote host computer 280 using automated scripts, such as stored commands that run an FTP (File Transfer Protocol) session or, alternately, using a sequence of commands manually entered into host computer 280. Image processing information that has been acquired by networked server 260 is stored in memory as a file on networked server 260. Data from remote host computer 280, received by networked server 260 using the same network protocol arrangement, can then be transferred to control logic processor 130 for modifying process variables used in operation of printer 230.

The arrangement shown FIG. 8 can also be used by a media or equipment manufacturer to access information concerning printer condition. That is, host computer 280 may be used to poll networked server 260 periodically in order to perform remote diagnostics or check the condition of remotely disposed printer 230 components. Using the network arrangement shown in FIG. 8, a manufacturer could automatically notify service personnel of a printer 230 problem, or download revised operational or calibration data to improve printer 230 performance.

The arrangement of FIG. 8 may also be used by a media manufacturer to track media use. Host computer 280 can be used to poll networked server 260 periodically in order to check on consumable levels of receiver substrate supply 50, laminate supply 160, intermediate receiver supply 38, or donor supply 35. As shown in FIG. 8, using the reader/identifier method in the form of transceiver 180 and transponder 200 and commands from host computer 280 that are received by networked server 260, reader 70 can be instructed to read identifier 60 and thereby determine the level of supply of receiver substrate media. This same method could be extended to the system shown in FIG. 5 for determining consumable media levels for laminate supply 160, intermediate receiver supply 38, or donor supply 35. The results of this data-gathering could then be employed for accounting and billing purposes or for automating re-order of consumable paper, laminate, intermediate, and donor or colorant materials.

Figure 9:
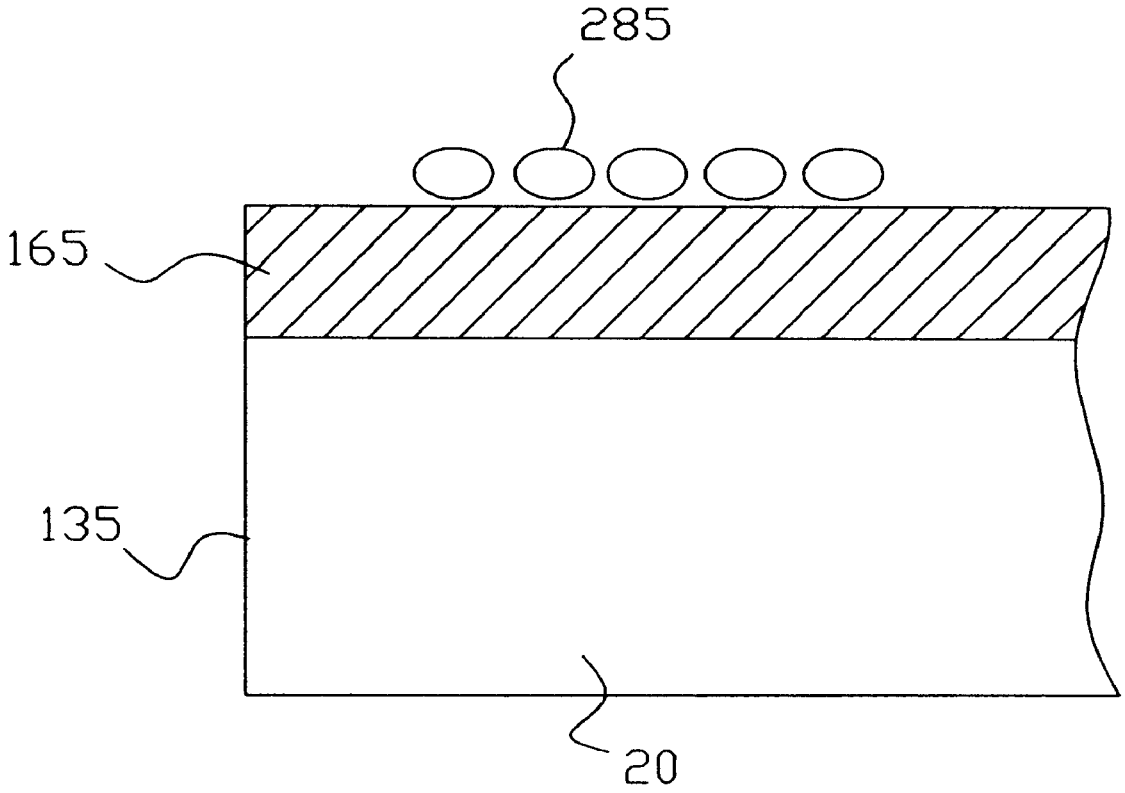
FIG. 9 is a view in cross-section showing structure of the output receiver substrate that is capable of accepting a printed image.

FIG. 9 shows a cross section view of receiver substrate 20 using receiver substrate 20. Laminate layer 165 has been applied to receiver substrate 20. However, 10 laminate layer 165 is optional. A deposited colorant 285 is applied to receiver substrate 20 to provide the print that is the final output from printers 10/100/230.

It should be appreciated from the description hereinabove that an advantage of the present invention is that costs due to the operator having to make densitometer measurements of paper color content prior to printing are reduced. This is so because densitometer measurements of paper color content are contained in the identifying information embodied in the media identifier.

Another advantage of the present invention is that there is no longer a need for the printer operator to determine a compromise calibration strategy when a site uses two or more papers that vary widely in color characteristics. This is so because the printer is automatically calibrated for paper color content due to the identifying information being embodied in each specific media to be used in the printer.

Still another advantage of the present invention is that there is no longer a need for the printer operator to acquire pre-knowledge concerning details about the output receiver that will be used for the proof. This is so because details about the paper to be used for the proof is contained in identifying information embodied in the identifier for media to be used in the printer.

Yet another advantage of the present invention is that there is no longer a need for the printer operator to ascertain how the prelaminate material will affect color of the output receiver or a need for the operator to ascertain how to vary heat, pressure, and contact time to control the effectiveness of colorant transfer which affects density of the final printed image. This is so because the identifier associated with the media contains information concerning how the prelaminate material will affect color of the output receiver and how to vary heat, pressure, and contact time to control the effectiveness of colorant transfer which affects density of the final printed image.

A further advantage of the present invention is that there is no longer a need for the printer operator to determine preconditioning for a paper receiver substrate. This is so because the present invention automatically accommodates the variable preconditioning required for a an output receiver substrate due to preconditioning information being contained in the identifier.

Another advantage of the present invention is that the printer operator need not obtain current data on media interaction available subsequent to the date of manufacture and manually adjust the printer accordingly. This is so because current data on media interaction can be obtained directly from a manufacturer as identifier information and provided to the printer, such as by means of the electronic remote access network.

While the invention has been described with particular reference to its preferred embodiments, it will be understood by those skilled in the art that various changes may be made and equivalents may be substituted for elements in the preferred embodiments without departing from the scope of the invention. For example, printers 10/100/230 can be adapted for sensing using any number of transceivers 50 and antenna 190, disposed at suitable locations. As another example, printers 10/100/230 may be adapted to require an operator to initiate a special read sequence, whether using a transceiver 180/transponder 200, a bar code reader or other optical or magnetic reader device. As another example, paper conditioning component 150 and image transfer apparatus 40 may be the same device and may or may not be housed independently from or electronically connected with image marker 30 or control logic processor 130. As still another example, read/write capability need not necessarily be limited to memory 210 attached to a transponder 200. A magnetic strip may be employed for storage and updating of usage information. Also, reader 70 could be hand-held as well as positioned within printers 10/100/230. Further, the network connection in printer 230 shown in FIG. 8 allows a number of variations in implementation, including possible network connection to multiple host computers 280.

Moreover, it may be appreciated that this invention can be employed at a separate paper conditioning component (e.g., laminator), disposed remotely from either of printers 10/100/230. This would allow a site to use a laminator or other paper conditioning component that is installed at a location other than near any of printers 10/100/230. As is shown in FIG. 5, laminate supply 160 would be equipped with identifier 60*d*. Receiver conditioning component 150, as well as the laminator, could be provided with reader 70*c*. Receiver substrate 20 (printed or un-printed) could then be laminated separately by such a remotely disposed conditioning component.

Therefore, what is provided is a printer capable of forming an image on a receiver substrate according to type of receiver substrate, and a method of assembling the printer.

Parts List

10. First embodiment printer
20. Output receiver substrate
30. Image marker
35. Donor supply
36. Donor supply tray
37. Intermediate receiver substrate
38. Intermediate receiver substrate supply
40. Image transfer apparatus
50. Paper supply
52. Paper supply tray
60. Identifier
60*a*. Identifier, intermediate receiver substrate
60*b*. Identifier for donor
60*c*. Identifier for final receiver substrate
60*d*. Identifier for laminate material
70. Reader
70*a*. Reader, image marker
70*b*. Reader, image transfer apparatus
70*c*. Reader, paper conditioning component
80. Computer
85. Keyboard
90. Printed output sheet
100. Second embodiment printer (prepress printer)
110. Datalink
110*a*. Data link, image marker
110*b*. Data link, image transfer apparatus
110*c*. Data link, paper conditioning component
130. Control logic processor
150. Paper conditioning component
160. Laminate supply
162. Laminate supply tray
165. Laminate layer

What is claimed is:

1. A printer capable of forming an image on a receiver substrate according to type of receiver substrate, comprising:

(a) a first identifier associated with an intermediate receiver substrate, said first identifier containing first identifying information uniquely associated with the type of intermediate receiver substrate;

(b) a first sensor disposed in sensing relation to said first identifier for sensing the first identifying infomation, so that the type of intermediate receiver substrate is identified as the first sensor senses the first identifying information;

(c) an image marker coupled to said first sensor for forming an image, using a colorant from a donor sheet or roll, on the intermediate receiver substrate according to the first identify information sensed by said first sensor;

(d) a second identifier coupled to a final receiver substrate, said second identifier containing second identifying information uniquely associated with the type of final receiver substrate;

(e) a second sensor disposed in sensing relation to said second identifier for sensing the second identifying information, so that the type of final receiver substrate is identified as the second sensor senses the second identifying information; and (f) a transfer processor for transferring the image on the intermediate receiver substrate to the final receiver substrate according to the second identifying information sensed by said second sensor.

2. The printer of claim 1 and wherein said first identifier is an optically encoded identifier, and wherein said sensor is an optical sensor for optically sensing said optically encoded identifier.

3. The printer of claim 1 and wherein said first identifier is a magnetically encoded identifier, and wherein said first sensor is a magnetic sensor for magnetically sensing said magnetically encoded identifier.

4. The printer of claim 1 and wherein said first identifier is a trace pattern encoded identifier, and wherein said first sensor is a trace pattern sensor for mechanically sensing said trace pattern encoded identifier.

5. The printer of claim 1 and wherein said first sensor comprises a transceiver capable of transmitting a first electromagnetic field and capable of sensing a second electromagnetic field characteristic of the identifying information, and wherein said identifier comprises a transponder capable of receiving the first electromagnetic field to power said transponder and in response to receiving the first electromagnetic field, generating the second electromagnetic field.

6. The printer of claim 5 and wherein said transponder comprises a memory for storing data characteristic of the first identifying information.

7. The printer of claim 5 and wherein said transceiver transmits the first electromagnetic field at a predetermined first radio frequency.

8. The printer of claim 1 and further comprising:

(g) a telecommunications link having a first portion and a second portion thereof, the first portion coupled to said image marker; and (h) a host computer coupled to the second portion of said telecommunications link, said host computer having a data source stored therein containing the first identifying information, whereby said telecommunications link carries the first identifying information from said host computer to said image marker for operating said image marker according to the first identifying information.

9. A printer including an image marker capable of forming an image on a receiver substrate according to type of receiver substrate, comprising:

(a) a first identifier associated with tile receiver substrate, said first identifier containing first identifying information uniquely associated with the type of receiver substrate;

(b) a first sensor disposed in sensing relation to sad first identifier fox sensing the first identifying information, so that the type of receiver substrate is identified in response to said sensor sensing the first identifying information;

(c) a preconditioning component coupled to sad image marker for conditioning the receiver substrate prior to forming the image on the receiver substrate, said preconditioning component being adapted to apply a laminate to the receiver substrate;

(d) a second identifier associated with sad laminate, said second identifier containing second identifying information uniquely associated with the type of laminate; and (e) a second sensor disposed in sensing relation to said second identifier for sensing the second identifying information, so that the type of laminate is identified in response to said second sensor sensing the second identifying information. information.

10. The printer of claim 9 and wherein said first identifier is an optically encoded identifier, and wherein said sensor is an optical sensor for optically sensing said optically encoded identifier.

11. The printer of claim 9 and wherein said first identifier is a magnetically encoded identifier, and wherein said first sensor is a magnetic sensor for magnetically sensing said magnetically encoded identifier.

12. The printer of claim 9 and wherein said first identifier is a trace pattern encoded identifier, and wherein said first sensor is a trace pattern sensor for mechanically sensing said trace pattern encoded identifier.

13. The printer of claim 9 and wherein said first sensor comprises a transceiver capable of transmitting a first electromagnetic field and capable of sensing a second electromagnetic field characteristic of the first identifying information, and wherein said first identifier comprises a transponder capable of receiving the first electromagnetic field to power said transponder and in response to receiving the first electromagnetic field, generating the second electromagnetic field.

14. The printer of claim 13 and wherein said transponder comprises a memory for storing data characteristic of the first identifying information.

15. The printer of claim 13 and wherein said transceiver transmits the first electromagnetic field at a predetermined first radio frequency.

16. The printer of claim 9 and further comprising:

(f) a telecommunications link having a first portion and a second portion thereof, the first portion coupled to said image marker; and (g) a host computer coupled to the second portion of said telecommunications link, said host computer having a data source stored therein containing the first identifying information, whereby said telecommunications link carries the first identifying infomation from said host computer to said image marker for operating said image marker according to the first identifying information.

17. The printer of claim 9 and further comprising a supply tray having the receiver substrate residing therein and said first identifier connected thereto.

18. A method of forming an image on a receiver substrate according to type of receiver substrate, comprising the steps of:

(a) providing a first identifier, said first identifier containing first identifying information uniquely associated with the type of an intermediate receiver substrate;

(b) sensing the first identifying information, so that the type of intermediate receiver substrate is identified;

(c) forming an image, using a colorant from a donor sheet or roll, on the intermediate receiver substrate according to the first identifying information that is sensed;

(d) providing a second identifier, said second identifier containing second identifying information uniquely associated with the type of final receiver substrate;

(e) sensing the second identifying information, so that the type of final receiver substrate is identified; and (f) transferring the image on the intermediate receiver substrate to the final receiver substrate according to the second identifying information that is sensed.

19. The method of claim 18 and wherein the second identifier is formed on a sheet provided in a package containing a plurality of final receiver substrates.

20. The method of claim 18 and wherein the first identifier is coupled to the intermediate receiver substrate and the second identifier is coupled to the final receiver substrate.

21. The method of claim 18 and wherein said first identifier is an optically encoded identifier, and wherein an optical sensor optically senses said optically encoded identifier.

22. The method of claim 18 and wherein said first identifier is a magnetically encoded identifier, and wherein a magnetic sensor magnetically senses said magnetically encoded identifier.

23. The method of claim 18 and wherein said first identifier is a trace pattern encoded identifier, and wherein a trace pattern sensor mechanically senses said trace pattern encoded identifier.

24. The method of claim 18 and wherein a sensor that comprises a transceiver transmits a first electromagnetic field and senses a second electromagnetic field characteristic of the first identifying information, and said first identifier comprises a transponder that receives the first electromagnetic field to power said transponder in response to receiving the first electromagnetic field and generates the second electromagnetic field.

25. The method of claim 24 and wherein said transponder comprises a memory for storing data characteristic of the first identifying information.

26. The method of claim 18 and wherein a telecommunications link having a first portion and a second portion thereof, the first portion being coupled to an image marker for forming the image on the intermediate receiver substrate and a host computer is coupled to the second portion of said telecommunications link, said host computer having a data source stored therein and containing the first identifying information, whereby said telecommunications link carries the first identifying information from said host computer to said image marker.

27. The method of claim 18 and wherein there is provided a third identifier, said third identifier containing third identifying information uniquely associated with a type of a donor material, sensing the third identifying information so that the type of donor material is identified, and forming the image on the intermediate receiver substrate according to the first and third identifying information that is sensed.

28. The method of claim 27 and wherein said first identifier comprises a first memory connected to the intermediate receiver substrate or a supply thereof and said first memory stores said first identifying information, said second identifier comprises a second memory connected to the final receiver substrate or a supply thereof and said second memory stores said second identifying information, and the third identifier is stored in a third memory connected to the donor material or a supply thereof and said third memory stores said third identifying information.

29. The method of claim 28 and wherein a sensor that comprises a transceiver transmits a first electromagnetic field and senses a second electromagnetic field characteristic of the first identifying information, and said first identifier comprises a transponder that receives the first electromagnetic field to power said transponder in response to receiving the first electromagnetic field and generates the second electromagnetic field.

30. The method of claim 27 and wherein there is provided a fourth identifier, said fourth identifier containing fourth identifying information uniquely associated with a type of laminate material, sensing the fourth identifying information so that the type of laminate material is identified, and preconditioning the final receiver substrate prior to forming the image thereon by applying the laminate to the final receiver substrate in accordance with the fourth identifying information.

31. The method of claim 30 and wherein the fourth identifier comprises a fourth memory connected to the laminate material or a supply thereof and said fourth memory stores said fourth identifying information.

32. The method of claim 27 and wherein there is provided a fourth identifier, said fourth identifier containing fourth identifying information uniquely associated with a type of laminate material, sensing the fourth identifying information so that the type of laminate material is identified, and preconditioning the final receiver substrate prior to forming the image thereon by applying the laminate to the final receiver substrate and transferring the image on the intermediate receiver substrate to the preconditioning final receiver substrate according to the second identifying information and the fourth identifying information.

33. The method of claim 32 and wherein said first identifier comprises a first memory connected to the intermediate receiver substrate or a supply thereof and said first memory stores said first identifying information, said second identifier comprises a second memory connected to the final receiver substrate or a supply thereof and said second memory stores said second identifying information, and the third identifier comprises a third memory connected to the donor material or a supply thereof and said third memory stores said third identifying information.

34. A method of forming an image on a receiver substrate according to type of receiver substrate, comprising the steps of:

(a) providing a first identifier, said first identifier containing first identifying information uniquely associated with the type of receiver substrate;

(b) sensing the first identifying information, so that the type of receiver substrate is identified;

(c) providing a laminate member;

(d) providing a second identifier, said second identifier containing second identifying information uniquely associated with the type of laminate;

(e) sensing the second identifier, so that the type of laminate is identified; and (f) preconditioning the receiver substrate prior to forming the image on the receiver substrate by applying the laminate thereto; and (g) operating an image marker to form the image on the receiver substrate in accordance with the first and second identifying information.

35. The method of claim 34 and wherein the first identifier is coupled to the receiver substrate.

36. The method of claim 34 and wherein the first identifier is located on a sheet that forms part of a stack of sheets that includes the receiver substrate.

37. The method of claim 34 and wherein said first identifier is an optically encoded identifier, and wherein an optical sensor optically senses said optically encoded identifier.

38. The method of claim 34 and wherein said first identifier is a magnetically encoded identifier, and wherein a magnetic sensor magnetically senses said magnetically encoded identifier.

39. The method of claim 34 and wherein said first identifier is a trace pattern encoded identifier, and wherein a trace pattern sensor mechanically senses said trace pattern encoded identifier.

40. The method of claim 34 and wherein a sensor that comprises a transceiver transmits a first electromagnetic field and senses a second electromagnetic field characteristic of the first identifying information, and said first identifier comprises a transponder that receives the first electromagnetic field to power said transponder in response to receiving the first electromagnetic field and generates the second electromagnetic field.

41. The method of claim 40 and wherein said transponder comprises a memory for storing data characteristic of the first identifying information.

42. The method of claim 41 and wherein said second identifier comprises a second transponder and a second memory for storing data characteristic of the second identifying information.

43. The method of claim 42 and wherein the second transponder is powered by a third electromagnetic field from a transceiver and generates, in response to the third magnetic field, a fourth magnetic field that includes the characteristic of the second identifying information.

44. The method of claim 31 and wherein a telecommunications link having a first portion and a second portion thereof, the first portion being coupled to an image marker for forming the image on the laminated receiver substrate and a host computer is coupled to the second portion of said telecommunications link, said host computer having a data source stored therein and containing the first identifying information, whereby said telecommunications link carries the first identifying information from said host computer to said image marker.

45. A method of forming an image on a receiver substrate according to type of receiver substrate, comprising the steps of:

(a) providing a first identifier, said first identifier containing first identifying information uniquely associated with the type of receiver substrate;

(b) sensing the first identifying information, so that the type of receiver substrate is identified;

(c) providing a laminate member;

(d) providing a second identifier, said second identifier containing second identifying information uniquely associated with the type of laminate;

(e) sensing the second identifier, so that the type of laminate is identified; and (f) preconditioning the receiver substrate prior to forming the image on the receiver substrate by applying the laminate thereto in accordance with the first and second identifying information; and (g) operating an image marker to form the image on the laminated receiver substrate in accordance with at least the second identifying information.

46. The method of claim 45 and wherein said first identifier comprises a first memory connected to the receiver substrate or a supply thereof and said first memory stores said first identifying information, said second identifier comprises a second memory connected to the laminate member or a supply thereof and said second memory stores said second identifying information.

47. The method of claim 46 and wherein a sensor that comprises a transceiver transmits a first electromagnetic field and senses a second electromagnetic field characteristic of the first identifying information, and said first identifier comprises a first transponder that receives the first electromagnetic field to power said transponder in response to receiving the first electromagnetic field and generates the second electromagnetic field.

48. The method of claim 47 and wherein said second memory is part of a second transponder and said transceiver polls said first and second transponders in sequence.

* * * * *